United States Patent [19]

Merisio

[11] 4,231,402

[45] Nov. 4, 1980

[54] DRAWING GRIPPER FOR WEAVING LOOMS

[75] Inventor: Alberto Merisio, Colzate, Italy

[73] Assignee: Somet Societa Meccanica Tessile, S.p.A., Bergamo, Italy

[21] Appl. No.: 12,250

[22] Filed: Feb. 15, 1979

Related U.S. Application Data

[63] Continuation of Ser. No. 862,904, Dec. 21, 1977, abandoned.

[30] Foreign Application Priority Data

Dec. 27, 1976 [IT] Italy ..... 30890 A/76

[51] Int. Cl.[3] ..... D03D 47/20

[52] U.S. Cl. ..... 139/448

[58] Field of Search ..... 139/447, 448

[56] References Cited

U.S. PATENT DOCUMENTS 2,960,118 11/1960 Ancet et al. ..... 139/448

FOREIGN PATENT DOCUMENTS 1391346 1/1965 France ..... 139/448

*Primary Examiner*—Henry Jaudon

*Attorney, Agent, or Firm*—Stevens, Davis, Miller & Mosher

[57] ABSTRACT

Drawing gripper for weaving looms with continuous weft feed comprising a claw ending into a hook and an oscillating element, rigidly cooperating with each other for holding the weft thread grasped by the hook, said element being caused to oscillate about its own longitudinal axis by being pivoted into a support of the gripper body as well as into the hook end of said claw.

3 Claims, 5 Drawing Figures

DRAWING GRIPPER FOR WEAVING LOOMS

This is a continuation of application Ser. No. 862,904 filed Dec. 21, 1977, now abandoned.

BACKGROUND OF THE INVENTION

The present invention relates to an improved drawing gripper for use in weaving looms with a continuous weft feed.

It is known that, in looms with a continuous weft feed, the shuttle is replaced by a pair of transport grippers, subject to reciprocating motion so as to alternately move towards and away from each other, the first of which—the carrying gripper—is adapted to grasp the weft threads at one end of the loom just outside the shed and to carry them inside the shed, up to the middle area thereof, while the second gripper—the drawing gripper—is adapted to partially penetrate into an appropriate seat of the first gripper, so as to draw said weft threads in said area and transport them in turn at the other end of the loom, outside the shed, and leave them there.

The progress in looms of this type is strictly connected with the efficiency of the weft transport grippers and thus it is easily understood why such members are at the center of all the searches in this field and are subject to continuous development in their practical realization.

The present invention relates to an improved drawing gripper for weaving looms with continuous weft feed and hence provides an important contribution to the progress of such looms.

The Applicant had already proposed in Italian Pat. No. 894,302—a drawing gripper of the type comprising a hook-shaped claw and an oscillating metallic element, elastically cooperating therewith. The oscillation of said element took place about an axis longitudinal to the gripper itself. On this same principle, the Applicant has now realized an improved drawing gripper, which however grasps the weft thread with a completely different means and with remarkable advantages from the point of view of the structure and its working.

SUMMARY OF THE INVENTION

The gripper according to this invention is substantially characterized in that it comprises a claw ending into a hook and an oscillating element. The claw and element rigidly cooperate with each other for holding the weft thread grasped by the hook. The element oscillates about its own longitudinal axis by being pivoted into a support of the gripper body as well as into the hook end of the claw.

The oscillating element of the gripper is elongated in shape and comprises, at its pivoting point to the gripper body, a tailpiece forming a loop with which is adapted to engage the weft-freeing member provided at the outlet of the shed on the loom.

BRIEF DESCRIPTION OF THE DRAWINGS

The invention is illustrated in detail by the accompanying drawing which shows a preferred embodiment thereof. This embodiment will now be described by way of example with reference to said drawing, in which.

DESCRIPTION OF THE PREFERRED EMBODIMENT

Figures 1, 2, 3, 4, 5:
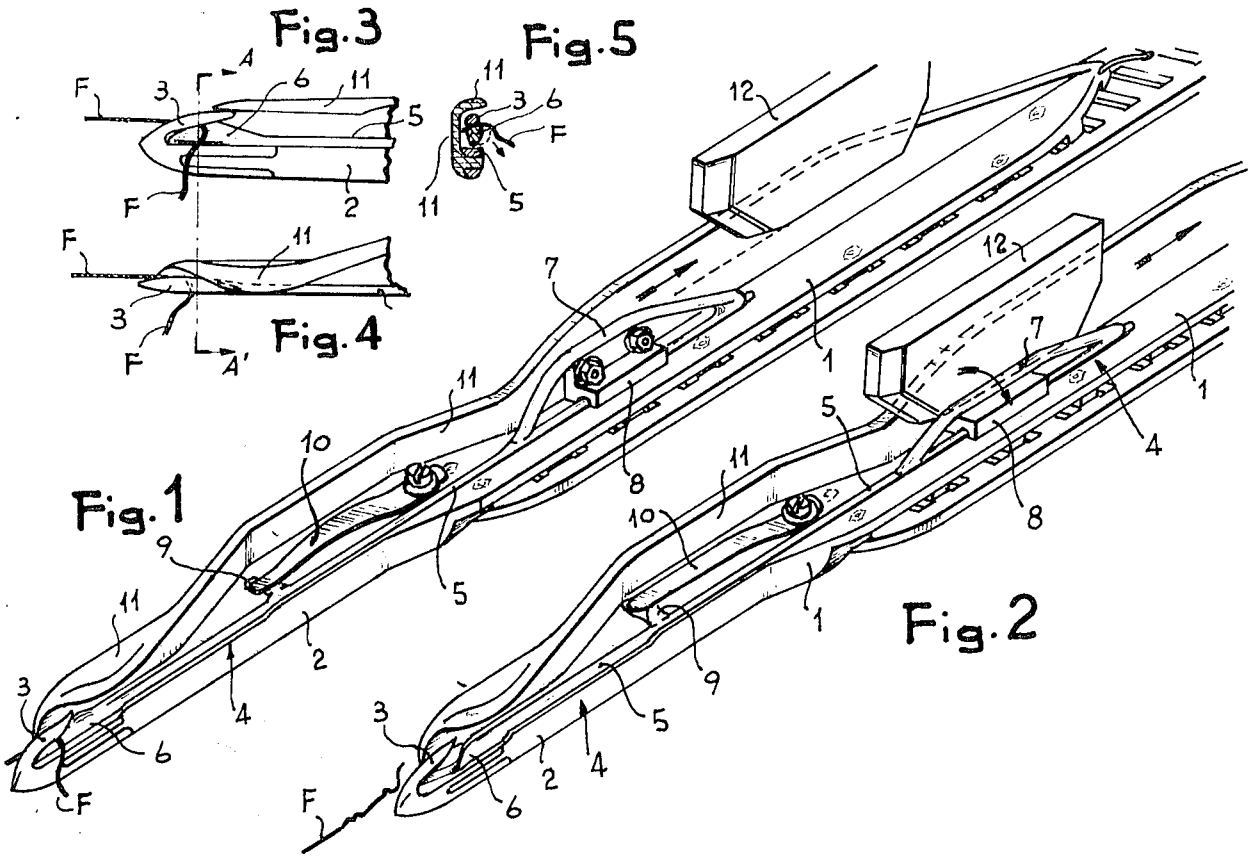
FIG. 1 is a prospect view of the drawing gripper according to the invention during transport of the weft thread.
FIG. 2 is a prospect view similar to that of FIG. 1, but during freeing of the weft thread.
FIGS. 3 and 4 are a side view and, respectively, a top view of the operation end of the gripper of FIGS. 1 and 2.
FIG. 5 is a cross-section on the line A—A' of FIGS. 3 and 4.

With reference to the Figures, the drawing gripper draws the weft thread from the carrying gripper at the center of the shed and transports it to the end of the shed opposite to the feeding end. The drawing gripper comprises a gripper body 1, preferably of synthetic plastic material, a fixed rigid claw 2 consisting of an elongated rectilinear metallic body the end of which is bent back towards it-self to form a hook 3, and an oscillating element 4 adapted to cooperate stiffly with the hook of the claw 2. The hook and the end of the oscillating element having profiles which are complementary to each other and which when in contact with each other will hold tightly anything placed therebetween.

According to the invention, the element 4 is formed by a very elongated (filiform) rectilinear metallic bar 5, terminating at one end with an enlargement 6 shaped substantially to the interior contour of the hook and, on the other end, with a tailpiece forming a loop (or eyelet) 7.

According to the invention, the element 4 is mounted to oscillate about its own longitudinal axis. In fact, the part of the bar 5 forming the loop 7 pivots in a support 8 of the gripper body 1, and the cylindrical extension of the profiled end of the bar 5 pivots in an appropriate seat obtained inside the hook 3 forming the end of the claw 2. The element 4 is further provided, on the intermediate part of the bar 5, with a transversal tailpiece 9 which engages the end of a return leaf spring 10 carried by the gripper body 1. Leaf spring 10 biases tailpiece 9 in a direction to pivot enlargement 6 into contact with the interior surface of hook 3.

The drawing also shows a vertical protection member 11, and a cam member 12 (which of course forms part of the loom and not of the gripper) in the form of a wedge with beveled surfaces.

The operation of the device is as follows: once the illustrated drawing gripper, has penetrated into the corresponding carrying gripper, the weft thread F is drawn therefrom by the hook 3 and tends to wedge itself between the profiled end 6 of the oscillating element 4 and the upper inner part of the same hook 3 (FIGS. 1, 3, 5). Such parts are of complementary shape and stiffly cooperate with each other to retain the thread F thanks to the combined action of the spring 10, which causes the element 4 to oscillate in the gripping position, and of the wedging-in effect produced by the stretching undergone by the weft thread, with a self-clamping action of the parts 3 and 6. The thread F is thus firmly retained by the gripper while the latter travels through the shed, as shown in FIG. 1.

When the gripper has come out of the shed, it meets on its path the freeing member 12. Member 12 engages the loop tailpiece 7 of the rear end of element 4 and, thanks to its wedge surface, causes the oscillation of the bar 5 about its own axis defined by the ends of the bar itself. The thread F is freed by the profiled end 6 of the element 4 moving away from the hook 3 as shown in FIG. 2.

The gripper according to the invention permits the obtaining of numerous very important advantages.

To start with, the pivoting at the two ends of the oscillating element 4 permits this element to be of a simple and light structure and, above all, to make its movements extremely precise and positive, eliminating the possibility of vibration during working. This helps to retain the thread even more efficiently and safely.

Moreover, the structure of the gripper is such that the possible resting thereon of the warp yarns acts in the sense of increasing the safety of the threads retention: in fact, any warp yarns resting on the gripper would urge the outer part of the loop 7 of element 6 to oscillate into the gripping position against the claw 2, in combination with the action of the spring 10.

It is understood that other embodiments of the gripper according to the invention are possible and that modifications or variants of the one illustrated may be made by the skilled in the art without difficulties: any resulting embodiments will of course fall within the scope of the present invention.

I claim:

1. Drawing gripper for weaving looms with continuous weft feed, comprising a gripper body, a claw attached to an end portion of said gripper body, said claw having a hook at one end, an oscillatable element positioned near one side of said body having at one end thereof an enlarged portion which is shaped to fit the interior contour of said hook, said interior contour of said hook and the enlarged portion of said oscillatable element cooperating with each other to wedge the weft thread grasped by the hook, and means on said body to allow oscillation of said element about its own longitudinal axis, the axis of said oscillatable element being arranged to pivot the enlarged portion externally of the profiled surface of the hook of said claw, on the side of the body where the oscillatable element is arranged and positioned below the upper interior surface of said hook where said enlarged portion contacts said hook.

2. The drawing gripper of claim 1, wherein said claw is an elongated rigid claw and said oscillating element is formed by a very elongated stiff bar provided on the other end, with a tailpiece forming a loop adapted to engage a cam for opening of the gripper.

3. The drawing gripper of claim 2, including a spring means mounted on said body and wherein said oscillating element has an intermediate lateral tailpiece thereon, said spring biasing said lateral tailpiece so that the enlarged shaped end surface of the oscillating element is pushed into engagement with the complementary contoured surface of the claw.

* * * * *